United States Patent [19]

Ives

[11] 4,256,169

[45] Mar. 17, 1981

[54] SHEAR PLUG FOR USE IN A CURVED ROLL-RACK

[75] Inventor: Kenneth D. Ives, Murrysville, Pa.

[73] Assignee: United States Steel Corporation, Pittsburgh, Pa.

[21] Appl. No.: 69,448

[22] Filed: Aug. 24, 1979

Related U.S. Application Data

[63] Continuation-in-part of Ser. No. 911,647, Jun. 1, 1978, abandoned.

[51] Int. Cl.[3] ..... B22D 11/128

[52] U.S. Cl. ..... 164/448; 73/141 R; 72/246

[58] Field of Search ..... 164/442, 448; 73/117.4, 73/141 R; 425/803; 72/237, 246

[56] References Cited

U.S. PATENT DOCUMENTS

| | | | |
|---|---|---|---|
| 830,432 | 9/1906 | Hennessey | 425/803 X |
| 3,213,680 | 10/1965 | Schaefer | 73/141 R |
| 3,411,353 | 11/1968 | Smyers | 73/141 R X |
| 4,056,140 | 11/1977 | Ives et al. | 164/448 X |
| 4,090,549 | 5/1978 | Ives et al. | 164/442 X |

*Primary Examiner*—Robert D. Baldwin

*Attorney, Agent, or Firm*—Walter P. Wood

[57] ABSTRACT

A shear plug particularly for use in combination with a load cell in the roll-rack of a continuous-casting machine. The plug includes a body which has a shallow recess in one face and an axially aligned and preferably deeper recess in the other face, and a wall separating the recesses. The shallow recess receives the end of a load cell of smaller dimensions. On application of an overload the load cell punches out a tapered segment from the wall. The plug does not expand sideways when it fails and is readily removed from the surrounding mechanism.

7 Claims, 4 Drawing Figures

SHEAR PLUG FOR USE IN A CURVED ROLL-RACK

This application is a continuation-in-part of my earlier application Ser. No. 911,647 filed June 1, 1978, now abandoned.

This invention relates to an improved shear plug particularly for use in combination with a load cell in a continuous-casting machine.

A conventional continuous-casting machine includes a curved roll-rack through which a partially solidified casting travels as its direction of travel changes from substantially vertical to horizontal. The roll-rack includes a plurality of opposed pairs of rolls which confine the casting against bulging. It is important that the size of gap between the rolls of each pair be closely controlled, both to prevent defects in the finished casting and to protect the roll-rack from damages caused by overloads. It is known to equip the roll-pairs with load cells which measure the force exerted by the casting on the rolls. Whenever the force measured at a roll-pair deviates from a norm, it is an indication that the rolls of this pair are improperly gapped and should be adjusted. Reference can be made to Ives and Vranka U.S. Pat. No. 4,090,549 or to Ives, Vranka and Wagner U.S. Pat. No. 4,056,140 for showings. The disclosures of these patents are incorporated herein by reference. Although I illustrate my invention as applied to the roll-rack of a continuous-casting machine, it is apparent the invention may have other application where similar problems are encountered.

Although the rolls of a roll-rack rotate on relatively fixed axis, it is desirable that provision be made for them to yield in response to overloads, such as occur when relatively cool enlarged end portions of a casting pass between the rolls. U.S. Pat. No. 4,090,549 shows expendable load cells which are crushed by overloads. U.S. Pat. No. 4,056,140 shows overload springs. It is known also to use shear plugs, but plugs used heretofore are difficult to remove after they have failed.

An object of my invention is to provide an improved shear plug which on failure does not expand sideways and is easily removed from the surrounding mechanism.

A further object is to provide, in combination, a load cell and shear plug in which the load cell punches out a tapered segment from the plug when overloads occur without expanding the plug sideways, whereby the plug is readily removed from the surrounding mechanism.

Figure 1:
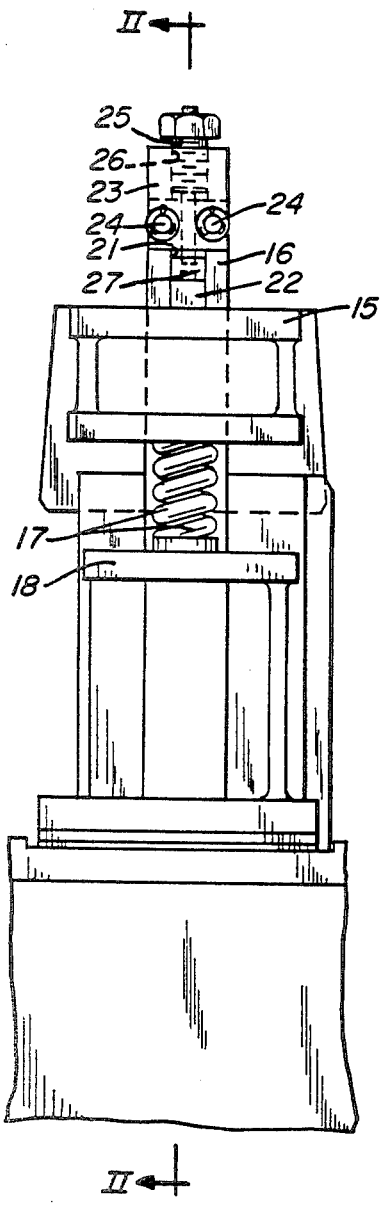
FIG. 1 is a front elevational view of a portion of a roll-rack equipped with a load cell and shear plug constructed in accordance with my invention.
Figure 2:
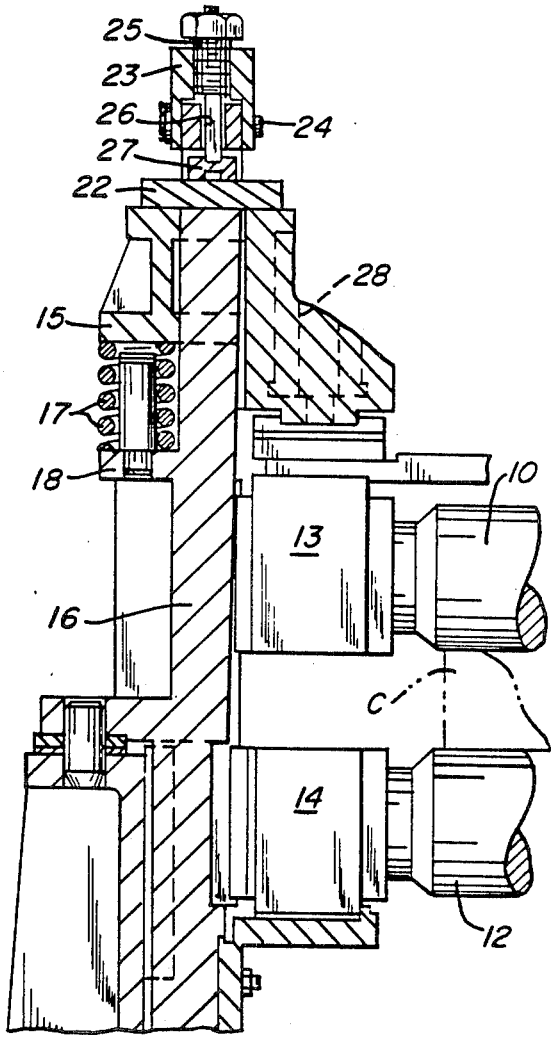
FIG. 2 is a vertical section on line II—II of FIG. 1.

FIGS. 1 and 2 show a portion of a roll-rack which is similar to that shown in U.S. Pat. No. 4,090,549 and includes top and bottom rolls 10 and 12, chocks 13 and 14 in which the rolls are journaled, and a frame 15 to which the top roll chock 13 is fixed. The rack also includes a tension strap 16 which extends along its side transversely of the path of a casting C between the rolls. A compression spring 17 bears against an integral lug 18 on the tension strap and against the frame 15 to urge the top roll away from the bottom roll. The description of the rolls as "top" and "bottom" does not imply that the top roll is directly above the bottom roll. In a curved roll rack the top rolls are the rolls at the concave side, and the bottom rolls are at the convex side regardless of the relative elevation of the rolls.

The tension strap 16 has an opening 21 near its top end. The top face of frame 15 abuts a block 22 which extends through the opening 21. An adapting nut 23 is fixed to the top of the tension strap with pins 24. A screw-type load cell 25 is threadedly engaged with nut 23 and extends freely through a hole 26 in the top of the tension strap into the opening 21. Alternatively the load cell may be threaded directly into the tension strap or otherwise directly fixed thereto. The bottom end of the load cell bears against a shear plug 27 which rests on the brick 22 and is constructed in accordance with my invention and herinafter described in detail. The load cell carries a strain gauge or equivalent within its interior to measure the load on the rolls, and it may be turned to adjust the roll gap, similar to the construction shown in U.S. Pat. No. 4,056,140. Preferably the frame 15 carries overload springs 28 which allow the rolls to yield to pass small overloads. The parts shown in FIGS. 1 and 2 are duplicated at the other end of the rolls.

Figure 3:
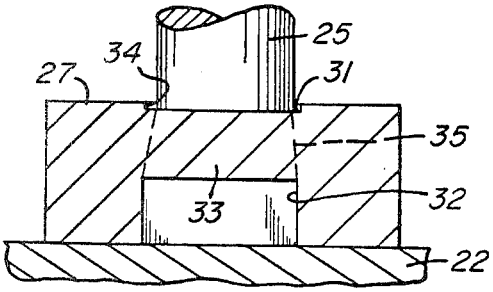
FIG. 3 is a vertical sectional view on a larger scale of the load cell and shear plug.

As shown in FIG. 3, the shear plug 27 is formed of a body, which may be rectangular, cylindrical or of other shape, and has a shallow recess 31 in its top face and an aligned preferably deeper recess 32 in its bottom face. The recesses are separated by a wall 33 of a thickness no greater than the depth of recess 32. The recess 31 receives the bottom end of the load cell 25. The load cell shown in circular in cross section to enable it to be turned for adjustment. For a load cell of this shape, I prefer that the recesses in the shear block likewise are circular. The diameter of the recesses is larger than the diameter of the load cell to allow clearance around the circumference of the load cell, as indicated at 34. The diameter of the bottom recess is at least as great as the diameter of the top recess. However, the recesses can be of other shape as long as their lateral dimensions are greater than those of the load cell.

When an overload occurs beyond the limits of spring 28, the load cell punches out a segment from the wall 33. The segment has an upwardly tapered outer peripheral face, as indicated by lines 35. The top of the segment has a diameter approximately equal to the diameter of the load cells 25, and the bottom a diameter approximately equal to the diameter of the recess 32. The sheared segment remains within the confines of the now annular body of the plug as long as the plug remains in place. Since the plug does not expand sideways when it fails, the plug is readily removed for replacement.

Figure 4:
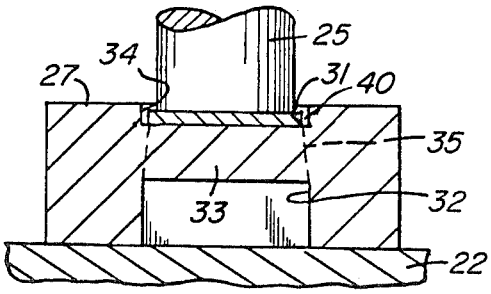
FIG. 4 is a vertical sectional view similar to FIG. 3, but showing a modification.

FIG. 4 shows a modification in which the shear plug includes a metal disk 40 placed within the shallow recess 31 overlying the wall 33. The recess 31 can be made slightly deeper than shown in FIG. 3 to accommodate the disk. The disk has a greater diameter than the load cell but still has clearance around the circumference of the recess. When an overload occurs and the shear plug fails, the upper end of the segment punched from the wall 33 has a diameter approximately equal to the diameter of disk 40. Since this diameter is greater than the diameter of the load cell, there is no tendency for the failed shear plug to bind on the load cell.

From the foregoing description, it is seen that my invention affords a shear plug of simple construction which overcomes the difficulty of removing the plug from the surrounding mechanism after it fails. It is not necessary to crush a more costly load cell as in the construction shown in U.S. Pat. No. 4,090,549. It is apparent the shear plug can be used in installations in which the punch is any rigid piece, not necessarily a load cell.

I claim:

1. A shear plug comprising an integral body having a relatively shallow recess in one face, an axially aligned recess in the opposite face, and a wall separating said recesses and being of a thickness no greater than the depth of said second-named recess, and a disk within said shallow recess overlying said wall, said shallow recess being adapted to receive punch means of smaller lateral dimensions than the dimensions of said disk, said wall being adapted to have a segment punched therefrom on failure of the plug, which segment, after being punched from said wall, tapers toward said shallow recess and remains within the confines of said body, the smaller end of said segment having lateral dimensions approximately equal to those of the disk and being greater than the lateral dimensions of the punch means.

2. A plug as defined in claim 1 in which the recesses are circular in cross section and one end of the segment formed on failure of the plug has a diameter approximately equal to the diameter of said disk and the other end has a diameter approximately equal to the diameter of said second-named recess.

3. The combination, with a mechanism which includes a load cell to measure loads applied to the mechanism, of a shear plug adapted to fail when overloads are applied thereto, said plug comprising an integral body having a relatively shallow recess in one face receiving said load cell and an axially aligned recess in the opposite face, and a wall separating said recesses and being of a thickness no greater than the depth of said second-named recess, said load cell having smaller lateral dimensions than said recesses and being adapted to punch out a segment from said wall on application of an overload, which segment after being punched from said wall tapers toward said load cell and remains within the confines of said body.

4. A combination as defined in claim 3 in which the load cell and the recesses are circular in cross section and one end of the segment formed on application of an overload has a diameter approximately equal to the load cell diameter and the other end has a diameter approximately equal to the diameter of said second-named recess.

5. A combination as defined in claim 3 in which said plug comprises in addition a disk within said shallow recess overlying said wall, said load cell, recesses and disk being circular in cross section, said disk having a greater diameter than said load cell, one end of the segment formed on application of an overload having a diameter approximately equal to the disk diameter.

6. In a curved roll-rack which includes:

an opposed pair of top and bottom rolls;

a tension strap;

means connected to said tension strap in which said rolls are journaled;

a load cell connected to said tension strap for measuring loads applied to said rolls; and a shear plug supported in said tension strap and engaged by said load cell and being adapted to fail when overloads are applied to said rolls;

the improvement in which said shear plug comprises:

an integral body having a relatively shallow recess in one face receiving said load cell and an aligned recess in the opposite face; and a wall separating said recesses and being of a thickness no greater than the depth of said second-named recess;

said load cell having a smaller diameter than said recesses and being adapted to punch out a segment from said wall on application of an overload to said rolls;

which segment after being punched from said wall tapers toward said load cell and remains within the confines of said body.

7. An improvement as defined in claim 6 in which said plug comprises in addition a disk within said shallow recess overlying said wall, said disk having a greater diameter than said load cell, one end of the segment formed on application of an overload having a diameter approximately equal to the disk diameter.

* * * * *